US007360262B2

(12) United States Patent
Mowery

(10) Patent No.: US 7,360,262 B2
(45) Date of Patent: Apr. 22, 2008

(54) LIFTING AND TRANSFER APPARATUS

(75) Inventor: Thomas E. Mowery, Plains, MT (US)

(73) Assignee: Elite Ltd., Plains, MT (US)

( * ) Notice: Subject to any disclaimer, the term of this patent is extended or adjusted under 35 U.S.C. 154(b) by 110 days.

(21) Appl. No.: 11/041,571

(22) Filed: Jan. 24, 2005

(65) Prior Publication Data

US 2006/0162069 A1 Jul. 27, 2006

(51) Int. Cl.
*A61G 7/10* (2006.01)

(52) U.S. Cl. ..... 5/87.1; 5/86.1; 5/83.1

(58) Field of Classification Search ..... 5/81.1 R–89.1
See application file for complete search history.

(56) References Cited

U.S. PATENT DOCUMENTS

| | | | | |
|---|---|---|---|---|
| 686,425 | A | 11/1901 | Sommerfeld | |
| 771,846 | A | 10/1904 | Thompson | |
| 802,728 | A | 10/1905 | Amos | |
| 935,170 | A | 9/1909 | Smith | |
| 1,450,950 | A | 4/1923 | Jenkins | |
| 1,782,406 | A * | 11/1930 | Bureau | 212/301 |
| 1,789,025 | A * | 1/1931 | Shepard, Jr. et al. | 187/230 |
| 1,878,785 | A | 9/1932 | Leavitt | |
| 2,368,390 | A * | 1/1945 | Winter | 5/86.1 |
| 2,666,212 | A * | 1/1954 | Flanders | 5/86.1 |
| 2,757,388 | A | 8/1956 | Chisholm | |
| 2,792,945 | A | 5/1957 | Brenny | |
| 3,104,399 | A | 9/1963 | Dalton | |
| 3,137,011 | A * | 6/1964 | Fischer | 5/86.1 |
| 3,392,410 | A | 7/1968 | Grahn | |
| 3,659,594 | A * | 5/1972 | Schwab | 606/237 |
| 3,694,829 | A | 10/1972 | Bakker | |
| 3,940,808 | A | 3/1976 | Petrini | |
| 3,999,228 | A | 12/1976 | Thomas | |
| 4,117,561 | A | 10/1978 | Zamotin | |
| 4,202,063 | A | 5/1980 | Murray | |
| 4,484,366 | A | 11/1984 | Koontz | |
| 4,496,062 | A | 1/1985 | Gattu et al. | |
| 4,571,758 | A | 2/1986 | Samuelsson | |
| 4,680,819 | A | 7/1987 | James | |
| 4,920,590 | A | 5/1990 | Weiner | |
| 5,077,844 | A | 1/1992 | Twitchell et al. | |
| 5,084,921 | A | 2/1992 | Hicks, Jr. | |
| 5,185,895 | A | 2/1993 | Gagne et al. | |
| 5,333,333 | A | 8/1994 | Mah | |
| 5,355,538 | A | 10/1994 | Fulford et al. | |
| 5,369,821 | A * | 12/1994 | Richards et al. | 5/86.1 |
| 5,379,468 | A | 1/1995 | Cassidy et al. | |
| 5,388,289 | A * | 2/1995 | Casperson | 5/86.1 |
| 5,406,658 | A | 4/1995 | Olkkonen et al. | |
| 5,459,891 | A | 10/1995 | Reeve et al. | |
| 5,560,054 | A | 10/1996 | Simon | |

(Continued)

*Primary Examiner*—Patricia Engle
*Assistant Examiner*—Jonathan J Liu
(74) *Attorney, Agent, or Firm*—Fraser Clemens Martin & Miller LLC; J. Douglas Miller

(57) ABSTRACT

A portable lifting apparatus for lifting and transferring of heavy objects. The lifting apparatus having a load-supporting platform which can be moved both vertically and rotated about the vertical axis of an upwardly extending lifting column. The lifting apparatus further includes an outrigger linkage coupled to the lifting column and is provided with a load support coupled to a retractable pulley. The lifting column is attached to a base and is normally prevented from rotating relative thereto.

8 Claims, 5 Drawing Sheets

U.S. PATENT DOCUMENTS 5,649,329 A 7/1997 Horcher et al.
5,682,630 A 11/1997 Simon
5,758,371 A 6/1998 VanDyke et al.
5,784,729 A 7/1998 Dunn et al.
5,802,633 A 9/1998 Capaldi
5,819,338 A 10/1998 Hession
5,946,748 A * 9/1999 Wang ..... 5/81.1 R
6,047,418 A 4/2000 Seide et al.
6,079,062 A * 6/2000 Mullin ..... 5/89.1
6,119,287 A 9/2000 Phillips
6,161,233 A * 12/2000 von Schroeter et al. ..... 5/86.1
6,170,802 B1 * 1/2001 Stovall ..... 254/8 B
6,260,218 B1 * 7/2001 Tsuga ..... 5/86.1
6,276,665 B1 * 8/2001 Hawkins et al. ..... 254/8 B
6,289,534 B1 * 9/2001 Hakamiun et al. ..... 5/89.1
6,321,398 B1 * 11/2001 Wang ..... 5/81.1 R
6,329,612 B1 * 12/2001 von Schroeter ..... 177/144
6,457,700 B1 * 10/2002 Hong ..... 254/8 B
6,557,189 B2 * 5/2003 Von Schroeter ..... 5/86.1
6,612,548 B2 * 9/2003 Landreth et al. ..... 254/8 R
6,857,144 B1 * 2/2005 Huang ..... 5/86.1
6,938,285 B2 * 9/2005 Fernie et al. ..... 5/83.1
2002/0038477 A1 * 4/2002 Mowery ..... 5/86.1
2006/0097557 A1 * 5/2006 Tholkes et al. ..... 297/330

* cited by examiner

LIFTING AND TRANSFER APPARATUS

FIELD OF THE INVENTION

The present invention relates to a lifting and transfer apparatus and more particularly to a portable lifting apparatus adapted for lifting and transferring invalid patients.

BACKGROUND OF THE INVENTION

Persons confined to a bed due to illness, age, or other infirmities often possess such limited mobility that movement or transfer is extremely difficult. Improper transfer can result in serious injury to the individual. Further, there is a need to move a patient who is bed ridden for exercise or bathing. Further, lifting the patient is ergonomically difficult for the nurses or other care-providers. There are many kinds of auxiliary equipment available for transferring and lifting patients. Such equipment includes beds which are adjustable in height, transfer chairs, various lifting devices on legs, bathroom lifters, and hoists suspended from the ceiling. Devices integrated into beds are typically not transportable. Auxiliary equipment, although often transportable, is frequently designed for specific limited purposes.

In the hospital venue, patient transfer is typically achieved by a number of attendants in order to lift the patient from one position to another. The patient is susceptible to injury from any incorrect manipulation by attendants.

Apparatus is available for lifting and transferring patients from a bed, chair, bath or similar positions. The Cagne U.S. Pat. No. 5,185,895 discloses a patient lifting apparatus which includes a base frame supporting vertically disposed guideposts for guiding a carriage for movement in response to a control signal applied by an attendant. An arm assembly extends over the patient who is placed into an associated lifting sling. Due to the size of the various components, the apparatus is not readily moveable.

Another apparatus effective for lifting and transferring patients is described in U.S. Pat. No. 5,084,921 to Hicks, Jr. which discloses a patient lifting and transferring apparatus with no provision for transportation of the entire apparatus.

The U.S. Pat. No. 5,560,054 to Simon discloses patient lift and transfer apparatus including a crane with a boom and a hoist mounted at the end thereof. The boom is coupled to a portable frame. An electric motor is operative to cause extension or retraction of the boom.

There is a need for a lifting and transferring apparatus capable of readily transferring a patient from a bed to a wheelchair and to assist in transferring the patient from a sitting position to a standing position to assist in transferring a patient from a wheelchair to a shower/commode chair and other care giving needs.

It is desirable to produce a lifting and transfer apparatus, which can be easily adapted to lift invalids.

It is also desirable to produce a lifting and transfer apparatus whereby an invalid person may be easily raised from a reclining position to a seated position.

It is also desirable to produce a lifting and transfer apparatus whereby a load-supporting platform can be raised or lowered, and rotated without moving the base of the apparatus.

It is also desirable to produce a lifting and transfer apparatus, which is portable.

SUMMARY OF THE INVENTION

Consistent and consonant with the present invention, a lifting and transferring apparatus capable of readily transferring a patient from a bed to a wheelchair and to assist in transferring the patient from a sitting position to a standing position to assist in transferring a patient from a wheelchair to a shower/commode chair and other care giving needs, has surprisingly been discovered.

In one embodiment, the lifting and transfer apparatus comprises a base; an upwardly extending lifting column having a first end and a spaced apart second end, the lifting column adapted to support an outrigger arm; a swivel interconnecting the first end of the lifting column to the base; a plurality of legs pivotally connected to the base, each of the legs having a ground engaging wheel disposed thereon, the legs pivotal about a substantially vertical axis; and an actuator disposed on the base, the actuator linked to each of the legs to cause the legs to pivot between a retracted and an extended position.

In another embodiment, the lifting and transfer apparatus comprises a base; an upwardly extending lifting column having a first end and a spaced apart second end; a swivel interconnecting the first end of the lifting column to the base; an outrigger arm having a first end and a spaced apart second end, the first end of the arm being affixed to the second end of the lifting column; an extensible and retractable grasping device for containing an invalid, the grasping device attached to the second end of the outrigger arm; a plurality of legs pivotally connected to the base, each of the legs having a ground engaging wheel disposed thereon, the legs pivotal about a substantially vertical axis; and an actuator disposed on the base, the actuator linked to each of the legs to selectively cause the legs to pivot between a retracted and an extended position.

In another embodiment, the lifting and transfer apparatus comprises a base; an upwardly extending lifting column having a first end, a second end, and at least a pair of telescoping members adapted to slide together along an axis one into another; a swivel interconnecting the first end of the lifting column to the base; a lock for militating against relative swivel movement between the base and the lifting column; an outrigger having a first end and a spaced apart second end, the first end of the outrigger being affixed to the second end of the lifting column; a load bearing rope having a grasping device for containing an invalid, the rope being retractably attached to the second end of the outrigger arm; a plurality of legs pivotally connected to the base, the legs pivotal about a substantially vertical axis; a ground engaging wheel disposed on each of the legs; an actuator disposed on the base; and a linkage system disposed between the actuator and the legs to link the actuator to each of the legs to cause the legs to pivot between a retracted and an extended position.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
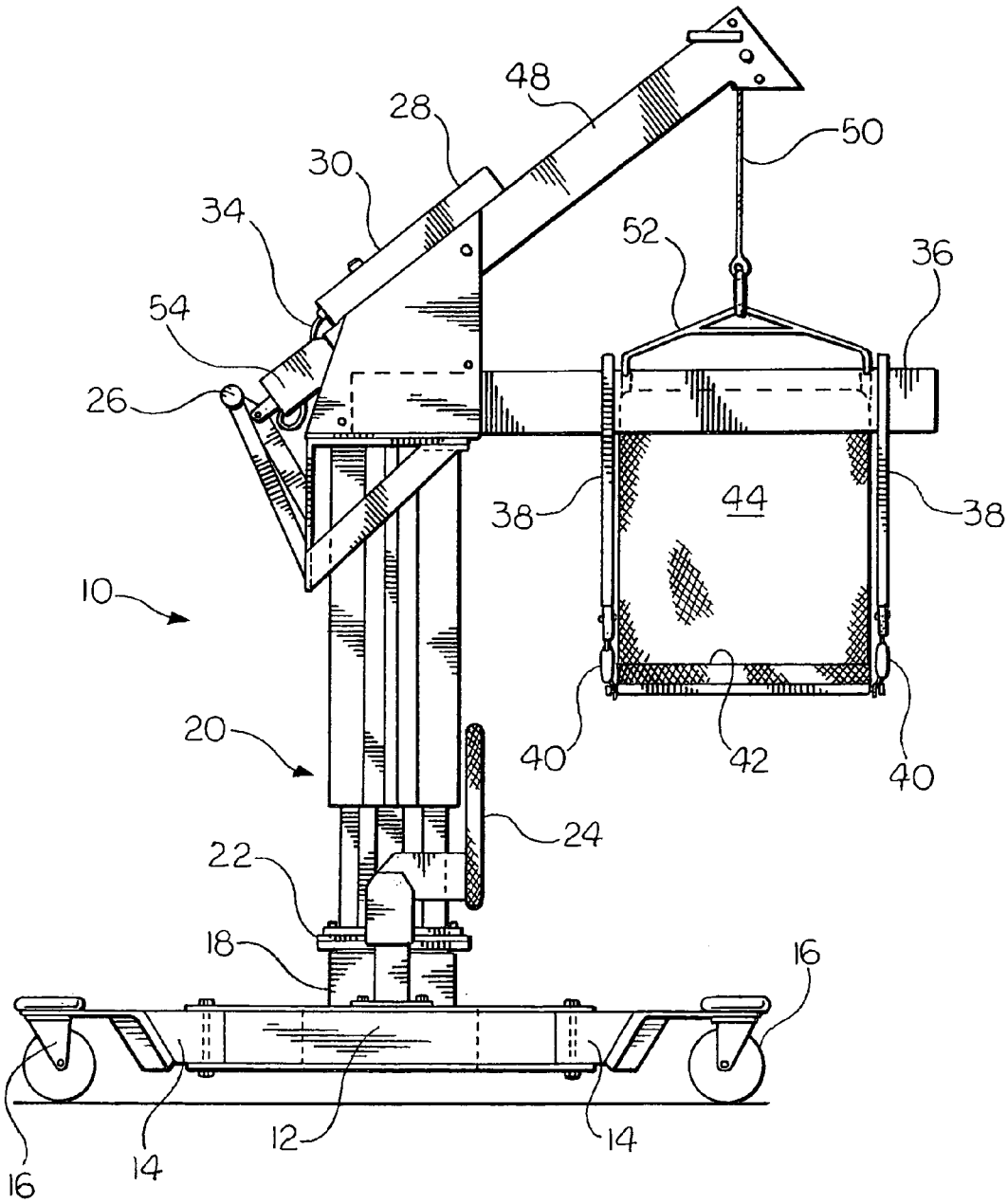
FIG. 1 is an end elevational view of a lifting and transfer apparatus according to an embodiment of the invention.

FIG. 1 depicts a lifting and transfer apparatus 10 according to an embodiment of the invention. The lifting and transfer apparatus 10 includes a substantially horizontally disposed rectangular base 12. Four legs 14 are adapted to extend outwardly from the base 12. In the preferred embodiment, the legs 14 are arranged in pairs, one pair of which is secured to one end of the base 12, while the other pair is secured at the opposite end. Ground engaging wheels or castor assemblies 16 are suitably secured to the distal ends of each leg 14. The legs 14 are individually pivotally mounted to the base 12 so as to pivot about a vertical axis.

The lifting and transfer apparatus 10 further includes an upwardly extending vertically disposed lifting column 20. A mounting plate 22 is interposed between the lower end of the lifting column 20 and a swivel mechanism 18 mounted on the base 12. The swivel mechanism 18 includes a lock which is normally actuated to prevent any relative rotational movement between the lifting column 20 and the base 12, as will be explained in greater detail hereinafter.

Figure 2:
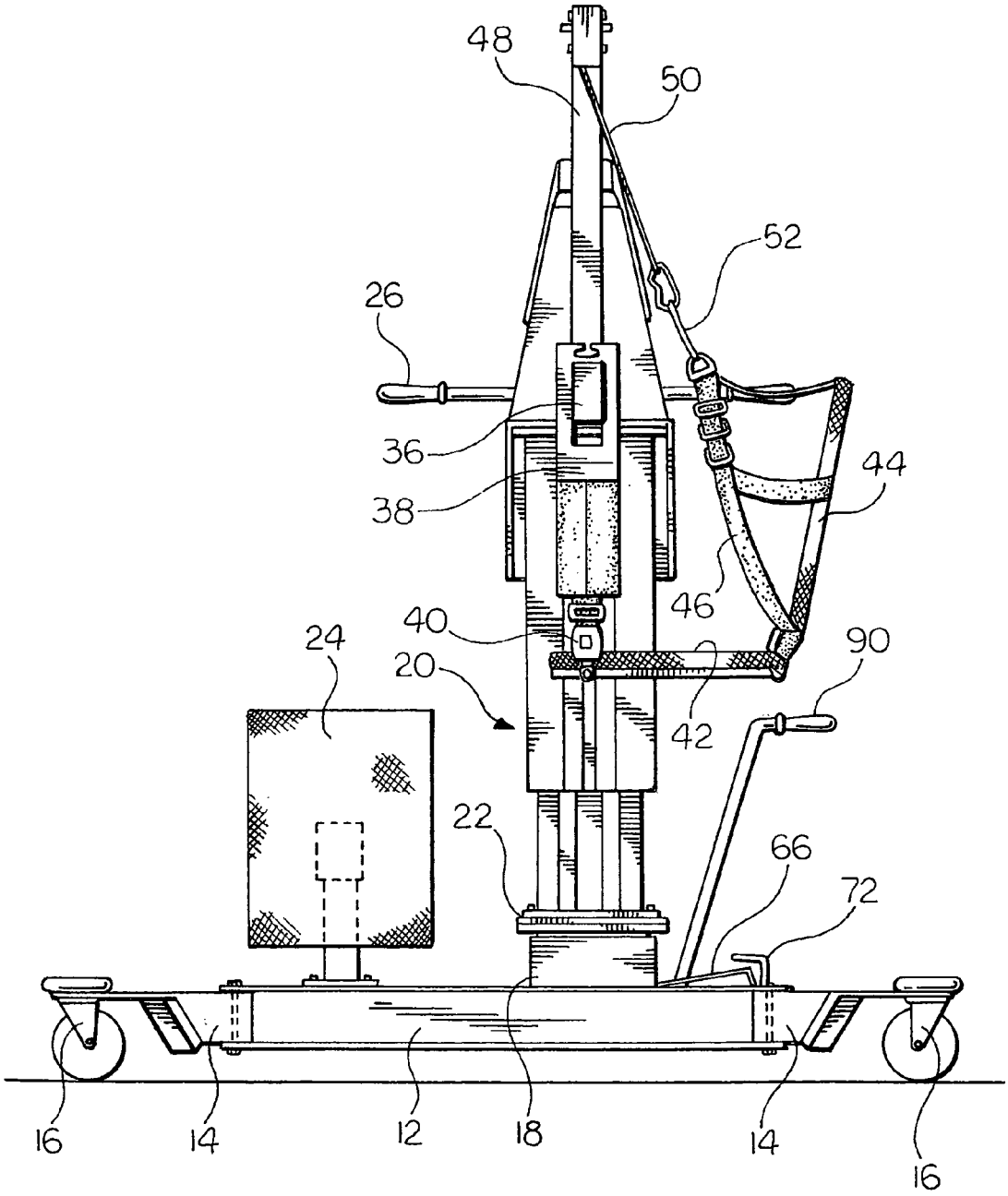
FIG. 2 is a side view of the lifting and transfer apparatus illustrated in FIG. 1.

Typically, the lifting column 20 is comprised of a pair of cooperating telescoping members which are adapted to slide together one into another as illustrated in the FIGS. 1 and 2. The length of the lifting column 20 may be increased from that shown by an internally disposed actuator system (not shown). The actuator system includes an electric DC motor, a drive gear, and a spindle including a drive nut. The gear between the motor and the spindle is developed to achieve an optimum function of the actuator system. It has been found satisfactory results may be obtained by utilizing a commercially available lifting column and actuator manufactured and sold by Linak of Denmark.

A steering handle 26 is disposed at the upper end of the upwardly extending lifting column 20. The electric motor of the lifting column 20 is coupled to a source of electrical energy such as, for example, a battery 28. The electric motor is further coupled to a control panel 30 which may include a handset control coupled to the control panel 30 through a flexible electrical cord 34.

A boom 36 is secured to the upper end of the lifting column 20 and is adapted to extend laterally outwardly therefrom. Two downwardly depending support arms 38 are slidingly coupled to the boom 36. An invalid supporting assembly is adapted to be coupled to the lower ends of the support arms 38 by releasable locks 40 such as automobile or airplane type seatbelt clasps, for example. In the embodiment shown, the invalid supporting assembly includes a seat 42, a seat back 44, and a patient lifting harness 46. The seat back 44 is coupled to the lifting harness 46. The seat back 44 and lifting harness 46 may be constructed of a suitable fabric or other durable and flexible material so as to provide support and comfort to a patient during lifting.

One end of a hollow outrigger 48 is affixed to the upper end of the lifting column 20. The other end of the outrigger 48 extends outwardly and upwardly at an angle and substantially in the same vertical plane as the boom 36. A load supporting rope 50 is disposed at the distal end of the outrigger 48. The term rope, as used herein, can include a cord, a cable, or other elongate member capable of supporting the patient. The rope 50 is disposed within the hollow interior of the outrigger 48, and is operatively connected to a retraction means such as an electric motor driven pulley (not shown), for example. The outermost end of the rope 50 is suitably secured to a V-shaped spreader bar 52. The ends of the V-shaped spreader bar 52 are adapted to be coupled to the patient lifting harness 46. The rope 50 is retracted by the electric motor 54 coupled to a source of electrical energy such as, for example, the battery 28 via the control panel 30. In the embodiment shown, the control panel 30 having the handset control is illustrated for controlling both the electric motor 54 coupled to the pulley for retracting the rope 50, and the electric motor coupled to the telescoping lifting column 20. However, it is understood that alternative embodiments may be used such as two control panels and two handset controls, for example.

Figure 3:
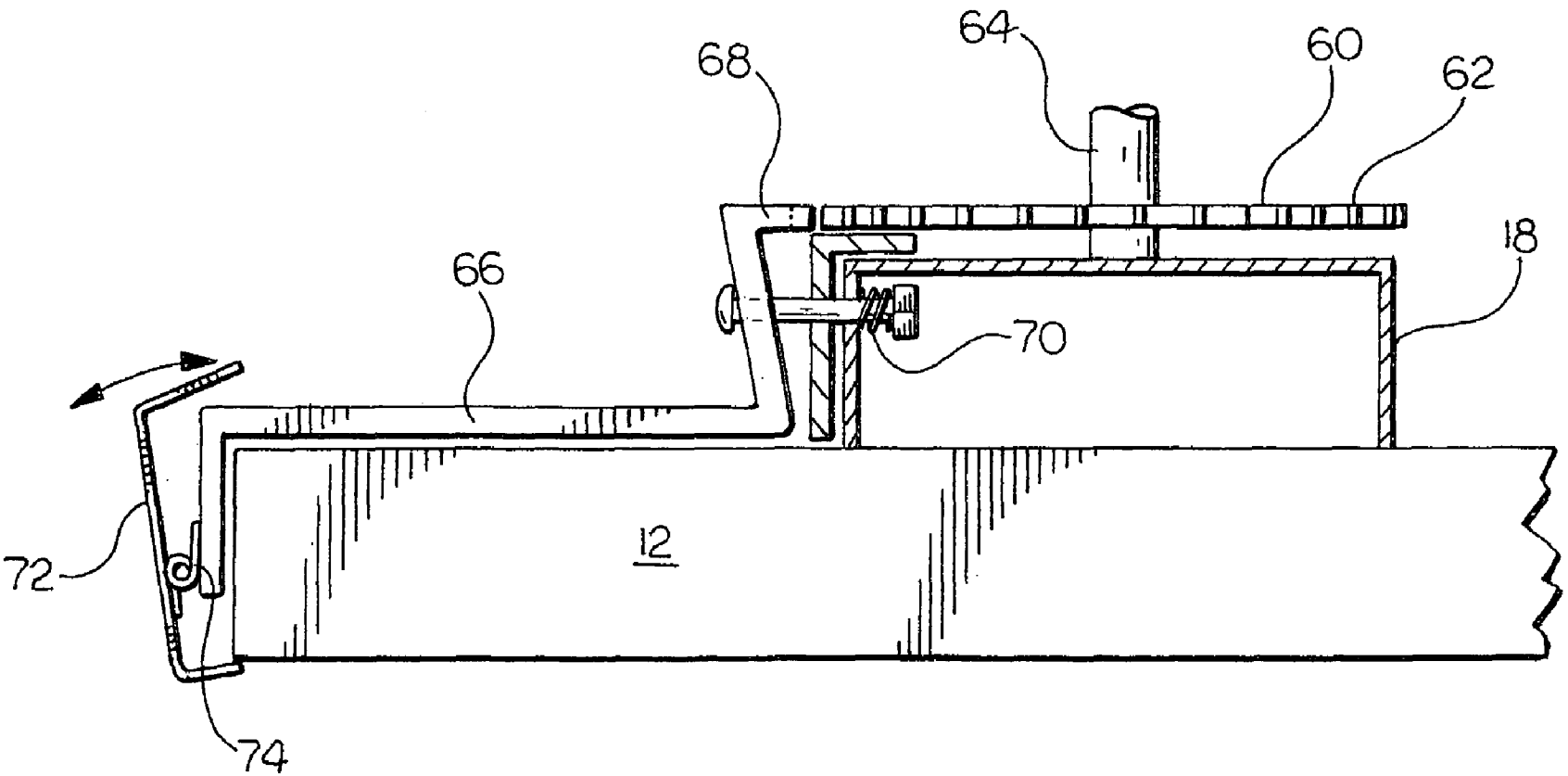
FIG. 3 is an enlarged fragmentary elevational view of the base of the lifting and transfer apparatus illustrated in FIGS. 1 and 2 showing an embodiment of the swivel lock structure.

FIG. 3 illustrates one embodiment of a locking structure for the swivel mechanism 18, which allows the base 12 to remain stationary in respect of the lifting column 20. An annular sprocket 60 having teeth 62 is shown extending around the entire outer periphery thereof. The sprocket 60 is illustrated as integral with the lifting column 20 and is generally affixed to a shaft 64, which functions to connect the lifting column 20 to the swivel mechanism 18. Normally, the sprocket 60 and the associated shaft 64 are locked to militate against a swiveling or rotating motion relative to the base 12. The locking structure operates to militate against relative movement between the lifting column 20 and the base 12. The locking structure illustrated includes a linkage 66, which is mounted to the swivel mechanism 18 which, in turn, is secured to the base 12. The locking assembly further includes a locking receiver 68 which is formed with a segment containing an array of cavities which are spaced to receive an annular arched group of the teeth 62 formed to extend radially from the sprocket 60. The linkage 66 and the associated receiver 68 are normally urged by a compression spring 70 such that the cavities of the receiver 68 are in engagement. Therefore, the lifting column 20 and the associated structure are prevented from rotating relative to the base 12. It is understood that other locking structures can be used without departing from the scope and spirit of the invention such as using a locking pin disposed between the base 12 and the lifting column 20, for example. The locking pin can be spring biased and include an operating lever connected to the pin by an operating cable. The use of the lever and cable permits a user to actuate the locking pin while standing in an upright position and does not require bending over to operate.

The cavities of the receiver 68 may be moved out of engagement with the teeth 62 of the sprocket 60 by pressing the spring biased lever 72 downward which is connected to the linkage 66 by a spring biased pivotal connection 74. The cavities of the receiver 68 may be re-engaged with the teeth 62 of the sprocket 60 by bumping the operator's foot against the spring biased lever 72.

Figure 5:
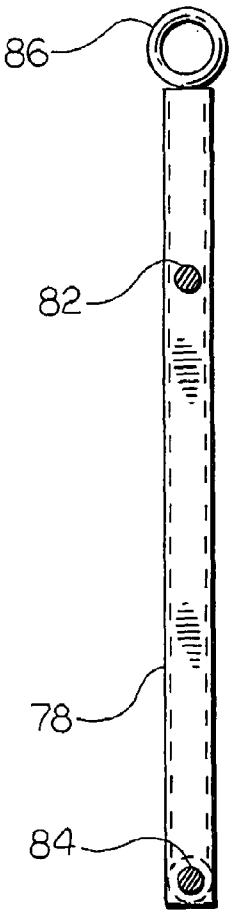
FIG. 5 is a sectional view of the attachment illustrated in FIG. 4 taken along line 5-5 thereof.
Figure 4:
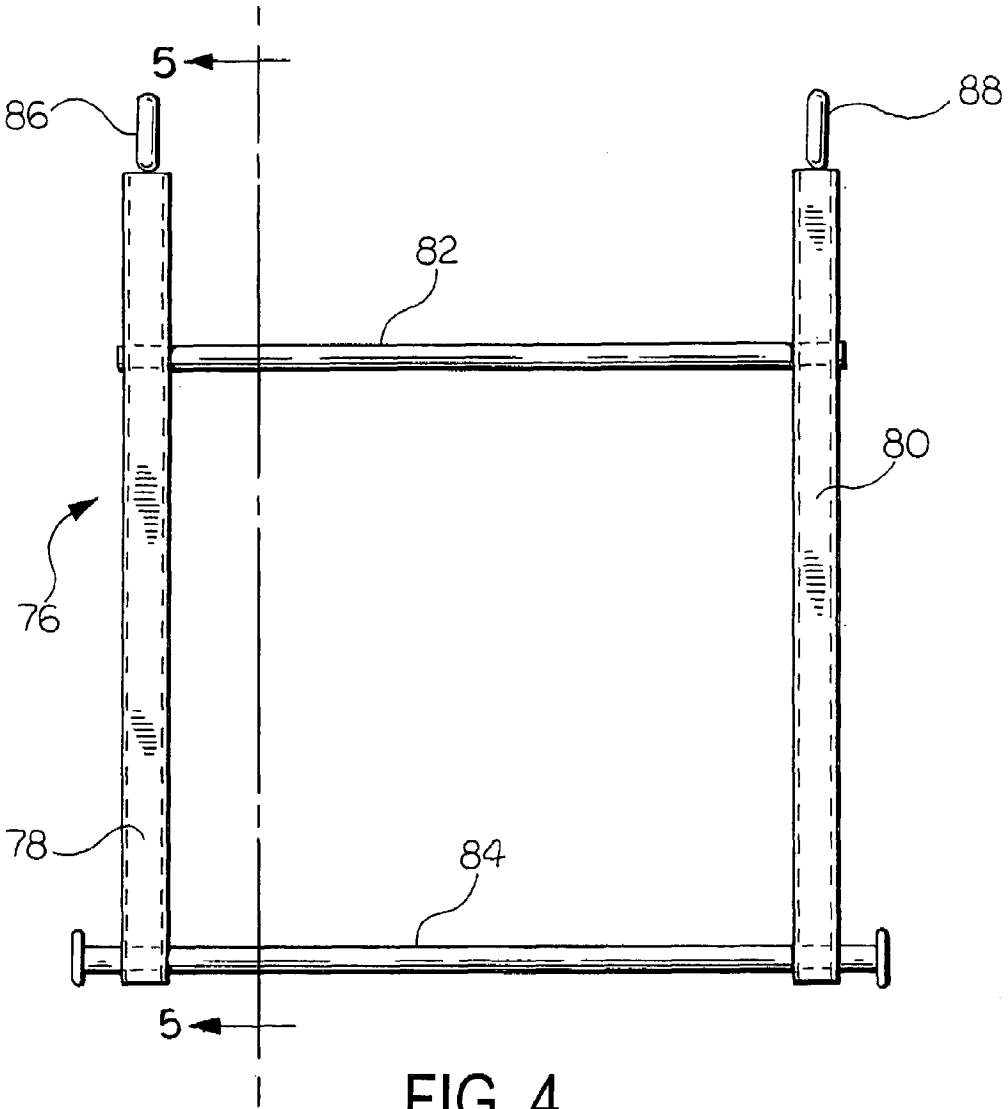
FIG. 4 is a front elevational view of an attachment, which will facilitate the movement of the invalid from a sitting to a standing position.

FIGS. 4 and 5 illustrate a set-to-stand framework 76. The framework 76 is comprised of a pair of vertically disposed spaced apart parallel side members 78 and 80 and a pair of horizontally disposed spaced apart parallel cross members 82 and 84. The ends of the cross members 82 and 84 are suitably secured to respective ones of the side members 78 and 80 by welding or other attachment means such as bolts, screws, or rivets, for example. The upper ends of the side members 78 and 80 are provided with suitable supporting rings 86 and 88, respectively. The side members 78 and 80 and the cross members 82 and 84 are typically formed of tubular metal stock. Therefore, the rings 86 and 88 may be welded or otherwise suitably connected to the side members 78 and 80. It will be understood that the components may be fastened together by other means such as, for example, press-fit, threaded fasteners, as well as, by welding.

Figure 6:
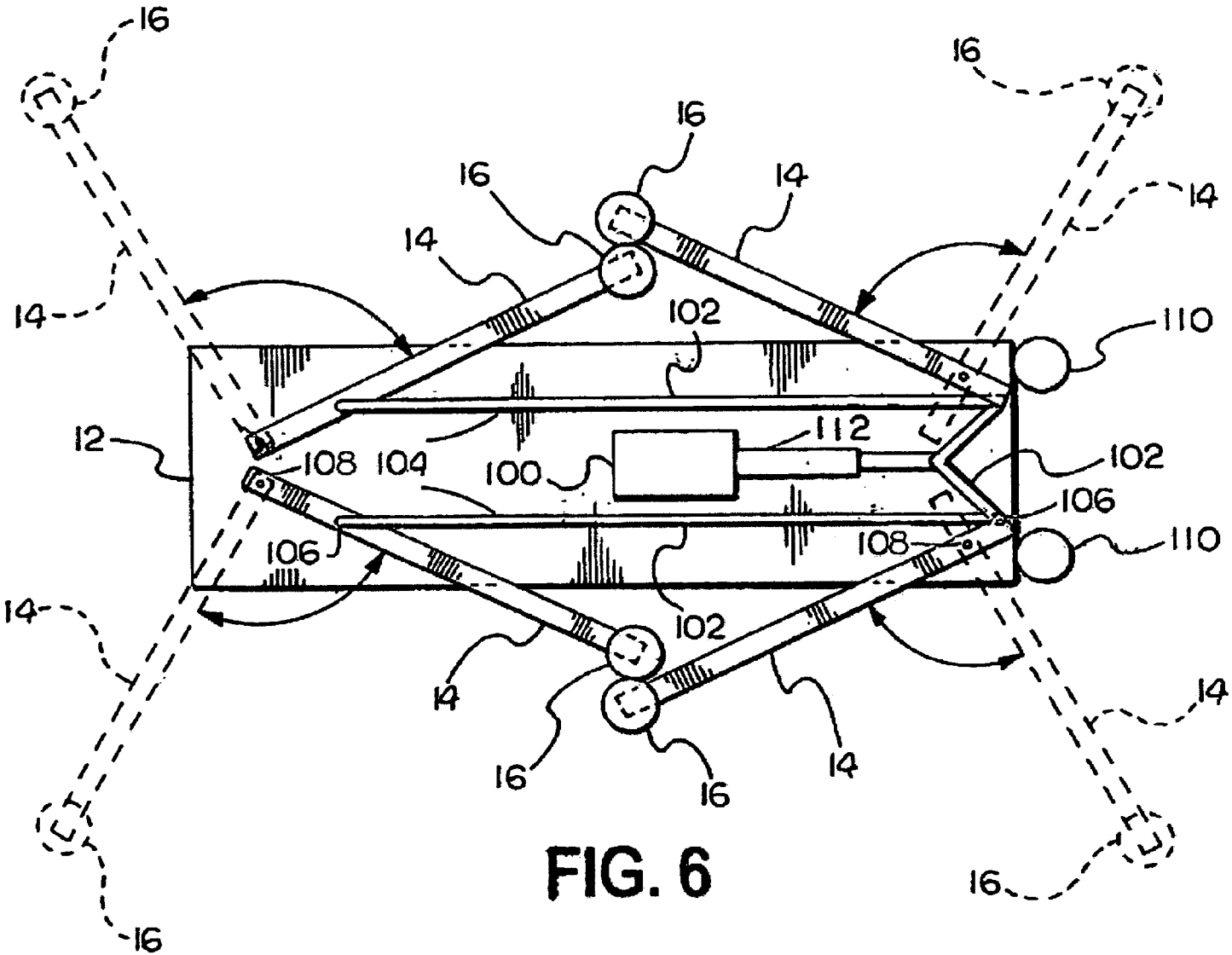
FIG. 6 is a schematic view of the base portion of the lifting and transfer apparatus including retractable legs.

FIG. 6 illustrates an embodiment of the invention where the legs 14 are retractable. An actuator 100 is disposed on the base 12. The actuator 100 can be any conventional type such as hydraulic or electric, for example. A linkage system 102 is disposed between the actuator 100 and the legs 14 to cooperate with the actuator 100 to cause the legs 14 to move between an extended and a folded position. The linkage system 102 can be a single linkage member or a plurality of linkage members 104 connected to effect the desired movement of the legs 14. For example. at least one of the linkage members 104 may be coupled to one of the legs 14 at a position 106 spaced apart from the leg connection 108 to the base 12. In one embodiment, the position 106 is intermediate the connection 108 of the leg 14 to the base 12 and the ground engaging wheel 16. In another embodiment, the position 106 is distal from the leg connection 108 to the base 12 and the ground engaging wheel 16. In the particular embodiment shown in FIG. 6. the linkage system 102 includes a linkage member 104 that is coupled to one of the legs 14 at the position 106 intermediate the connection 108 of the leg 14 to the base 12 and the ground engaging wheel 16. The linkage member 104 is also coupled to another of the legs 14 at the spaced position 106 distal from the leg connection 108 to the base 12 and the ground engaging wheel 16. Since the linkage member 104 is coupled to one of a first pair of the legs 14 and one of a second pair of the legs 14 at the different positions 106. the first pair of the legs 14 can be folded inside of the second pair of the legs 14. Additional wheels or castors 110 are provided on the base 12 for added stability of the lifting and transfer apparatus when the legs 14 are in the folded position. The actuator 100 can be controlled by the control panel 30, or other controller, as desired.

In operation, the base assembly 12 is positioned beneath a bed or a chair allowing an operator to position the incapacitated person on the load-supporting platform assembly, assist the patient into the lifting harness, and connect the lifting harness to the V-shaped spreader bar 52. The operator may actuate the cable retraction means, causing the rope 50 to be retracted within the hollow interior of the outrigger 48 and causing a reclining person to be raised to an upright, seated position. The operator may further actuate the telescoping lifting means causing the lifting column 20, and the associated load-supporting seat 44 to be extended upwardly. The operator may thereafter disengage the swivel lock, apply a lateral force to the handle 26 or the boom 36, and cause the boom 36 and load-supporting seat 44 to rotate about the vertical axis of the lifting column 20. The lifting apparatus 10 may also include an electric motor 54. The operator may prevent operation of the lifting apparatus 10 by opening a switch and interrupting the transmission of power from the battery 28.

The ability to raise and lower the invalid supporting assembly 40 and swing the assembly about the vertical axis of the lifting column 20 eliminates the need to move the base 12 of the lifting apparatus 10 with an incapacitated person when transferring an incapacitated person to auxiliary equipment, such as, for example, a wheelchair or a toilet chair. In the embodiment shown, a patient lifting and transfer apparatus 10 is illustrated. However, it will be understood the there are other embodiments of the invention such as, for example, for lifting heavy objects other than patients.

The frame illustrated in FIGS. 4 and 5 may be pivotally attached to the uppermost ends of the arms 38. The upper ends of the arms 38 are provided with slotted apertures generally in the shape of an inverted "T". The apertures are formed to receive respective ends of the cross member 84 such that the frame is pivotal about the axis of the cross member 84. At the same time, ends of the spreader bar 52 are hooked unto respective ones of the O-rings 86 and 88.

To move a patient, the lift column 20 is caused to be swiveled to a position ninety degrees clockwise from the position illustrated in FIGS. 1 and 2 and then allowed to be locked against swiveling movement. At this point, a seated invalid would place his/her knees against the padded vertically disposed support 24 illustrated in FIGS. 1 and 2. The operator then actuates the motor 54 to retract the rope 50, while the invalid firmly grasps the cross member 82. As the rope 50 is retracted, the cross member 82 is raised assisting the invalid to move from a seated to a standing position.

The structure may also be equipped with various means to control the pivotal position of the legs 14 with respect to the base 12. In one embodiment, there is provided a lever 90, illustrated in FIG. 2, which is coupled to control linkage disposed within the base 12. Manipulation of the lever 90 may be employed to actuate pivotal movement of the legs 14 typically in pairs such as, for example, the front legs and the rear legs. Such structure will permit transport of the apparatus through narrow doorways, for example.

Another embodiment of the means to control the pivotal position of the legs 14 with respect to the base 12 is using the actuator 100 and the linkage system 102. In the embodiment shown in FIG. 6, when it is desired to retract the legs 14 from the extended position, the actuator 100 is energized and an arm 112 thereof extended to cause the legs 14 to be pivoted into the retracted position. As shown in FIG. 6. the arm 112 may be a telescoping arm, for example. When it is desired to extend the legs 14, the actuator 100 is energized and the arm 112 thereof retracted to cause the legs 14 to be pivoted into the extended position. The retracted position of the legs 14 facilitates moving or storing of the lifting and transfer apparatus.

From the foregoing description, one ordinarily skilled in the art can easily ascertain the essential characteristics of this invention and, without departing from the spirit and scope thereof, can make various changes and modifications to the invention to adapt it to various usages and conditions in accordance with the scope of the appended claims.

What is claimed is:

1. A lifting and transfer apparatus comprising a base having a plurality of castors;

an upwardly extending lifting column having a first end and a spaced apart second end, said lifting column adapted to support an outrigger arm;

a swivel interconnecting the first end of said lifting column to said base;

a plurality of legs pivotally connected to said base, each of said legs having a ground engaging wheel disposed thereon, said legs pivotal about a substantially vertical axis, the plurality of legs including a first pair of legs and a second pair of legs; and an actuator disposed on said base including a telescoping arm linked to a linkage system, the linkage system having a linkage member coupled to one of the first pair of legs at a first position spaced from the connection of the one of the first pair of legs to the base, the first position intermediate the connection of the one of the first pair of legs to the base and the ground engaging wheel of the one of the first pair of legs, the linkage member coupled to one of the second pair of legs at a second position spaced from the connection of the one of the second pair of legs to the base, the second position not intermediate the connection of the one of the second pair of legs to the base and the ground engaging wheel of the one of the second pair of legs, said actuator selectively causing the linkage system to pivot the plurality of legs between a retracted position when the arm is caused to telescope outward, wherein the ground engaging wheel of each of the first pair of legs is folded inside of the ground engaging wheel of each of the second pair of legs, the ground engaging wheel of each of the second pair of legs overlapping the ground engaging wheel of each of the first pair of legs, and an extended position when the arm is caused to telescope inward.

2. A lifting and transfer apparatus according to claim 1, further comprising a lock for militating against relative movement between said base and said lifting column.

3. A lifting and transfer apparatus according to claim 2, wherein said lock includes a locking pin.

4. A lifting and transfer apparatus according to claim 3, wherein the locking pin is a spring loaded pin.

5. A lifting and transfer apparatus according to claim 2, wherein said lock includes a sprocket having radially outwardly extending teeth formed integrally therewith and the sprocket is rotatable with said lifting column.

6. A lifting and transfer apparatus according to claim 5, wherein said lock further comprises a spring biased detent affixed to said base, said detent selectively moveable into and out of contact with the sprocket.

7. A lifting and transfer apparatus according to claim 1, wherein the linkage system is disposed between said actuator and said legs.

8. A lifting and transfer apparatus according to claim 1, wherein the actuator is one of a hydraulic actuator, an electric actuator, and a piston and cylinder actuator.

* * * * *